US011884471B1

(12) United States Patent
Sanders

(10) Patent No.: US 11,884,471 B1
(45) Date of Patent: Jan. 30, 2024

(54) STORAGE CONTAINERS INCLUDING SELECTIVE COMPRESSION LEVELS

(71) Applicant: Carter Alonzo Sanders, Cordova, TN (US)

(72) Inventor: Carter Alonzo Sanders, Cordova, TN (US)

( * ) Notice: Subject to any disclaimer, the term of this patent is extended or adjusted under 35 U.S.C. 154(b) by 0 days.

(21) Appl. No.: 17/062,632

(22) Filed: Oct. 5, 2020

(51) Int. Cl.

| | |
|---|---|
| ***B65D 81/20*** | (2006.01) |
| ***B65D 51/24*** | (2006.01) |
| ***B65B 7/28*** | (2006.01) |
| ***B65B 31/00*** | (2006.01) |

(52) U.S. Cl.
CPC ..... *B65D 81/2038* (2013.01); *B65B 7/28* (2013.01); *B65B 31/00* (2013.01); *B65D 51/24* (2013.01)

(58) Field of Classification Search
USPC ..... 53/405
See application file for complete search history.

(56) References Cited

U.S. PATENT DOCUMENTS

| | | | | |
|---|---|---|---|---|
| 2015/0360927 | A1* | 12/2015 | Sweeney | B65D 1/04 222/41 |
| 2017/0172352 | A1* | 6/2017 | Bokma de Boer | B65D 85/70 |
| 2018/0111741 | A1* | 4/2018 | Kwok | A47J 47/10 |
| 2022/0002064 | A1* | 1/2022 | Carlos-Wallace | A24F 23/00 |

* cited by examiner

*Primary Examiner* — Chinyere J Rushing-Tucker
(74) *Attorney, Agent, or Firm* — William S. Parks

(57) ABSTRACT

A container (jar, for instance) with a lid device that applies selected levels of vacuum sealing to allow for different shelf-storage results on demand is disclosed. Such a lid includes a mechanical compression pump mechanism that applies different pressures in relation to external controls as well as indicators denoting such pressure levels upon operation. Such a resultant container thus allows a user to place perishable items therein and determine the level of seal thereto in relation to desired levels of firmness, freshness, or other shelf-storage result over a certain time period. The device further allows for opening, removal of perishable items therefrom, and resealing to a desired compression level thereafter with remaining items or new items in place. Such a device is particularly useful for *Cannabis*, CBD, tobacco, and other like items.

8 Claims, 4 Drawing Sheets

STORAGE CONTAINERS INCLUDING SELECTIVE COMPRESSION LEVELS

FIELD OF THE DISCLOSURE

The present disclosure pertains to a container (jar, for instance) with a lid device that applies selected levels of compression (including vacuum sealing) to allow for different shelf-storage results on demand. Such a lid includes a vacuum mechanism that applies different vacuum pressures in relation to external controls as well as indicators denoting such vacuum levels upon operation. Such a resultant container thus allows a user to place perishable items therein and determine the level of seal thereto in relation to desired levels of firmness, freshness, or other shelf-storage result over a certain time period. The device further allows for opening, removal of perishable items therefrom, and resealing to a desired vacuum level thereafter with remaining items or new items in place. Such a device is particularly useful for *Cannabis*, CBD, tobacco, and other like items.

BACKGROUND OF THE PRIOR ART

Perishable food and other like items have long faced difficulties in terms of storage, whether long- or short-term in breadth. In particular, the ability to allow a user fresh produce from field to table has long involved evolving procedures, including cold storage, chemical treatments, and sealing (including tin and other like canning). Salt has long been used as a preservative for certain items; newer, and questionable preservatives (sodium benzoate, for instance) has been utilized for storage potential as well. Such preservatives act to delay decomposition of certain perishable items by protecting from microbe infestation, basically. Desiccation has also been undertaken to dehumidify certain perishable items to reduce decomposition and retain flavor and freshness, as well.

Of great interest, currently, is the ability to allow for medicinal and/or recreational *Cannabis* usage with effective and/or viable buds in varying degrees of post-sowing state. Certain buds require facilitated and hastened aging after removal from a plant (ostensibly for quick usage, such as within 1-2 weeks after purchase or sowing), while others may be stored for far longer and thus require delayed aging (such as if larger amounts are purchased or grown and thus usage may be delayed while other sources are used). Intermediately, then, there may be others that are not in need of either quick aging or long-term storage without aging. The same may be said of other perishable items, including produce, meat, and the like. As such, though, the potential for a single article or device to provide such differentiated storage capabilities has been nonexistent, particularly within the *Cannabis*, CBD, etc., industries.

There have been some mechanically based storage devices that allow for relative humidity level changes upon closure, but such devices are limited in scope and fail to provide any vacuum changes, only moisture modifications. However, such devices lack vacuum sealing differentiation or, for that matter item compartmentalization (as a further possibility) for storage potential. Other devices merely accord cooling capabilities at differing temperatures, if desired. Either instance of relative humidity or cold storage level changes require significant electrical output for actual utilization, as well. In essence, the prior attempts at differing storage level capabilities within single devices have not proven to be viable for most perishable items, and certainly not as they would pertain to *Cannabis*, CBD, and the like products.

Thus, a definite need exists to provide a versatility, single device storage container that allows for more reliable and effective ranges of short to long-term storability for perishables. The ability for such plant to usage storage capacity and capability has not been disclosed within the pertinent industries to date.

BRIEF SUMMARY OF THE DISCLOSURE

Briefly stated, the preferred invention is directed to a container assembly with a mechanical air compression component integrated within a lid thereof. Such a compression (sealing) component allows for at least three different settings upon activation thereof in order to provide at least three different levels of sealing results in relation to the container (and perishable items present therein). In this manner, a user may close such a lid to a vessel (any structure that has a mouth opening and no other opening, with such a mouth opening complementary in shape to the lid for full enclosure upon contact and attachment therebetween), depress a compression activator (such as a button or like component that operates the mechanical air compression component) as many times as desired to generate an initial compression level within the assembly (again, lid and vessel in enclosed state). Such a seal (generated through such compression pump operation and through the presence and utilization of a gasket or like structure extending from the bottom of such a lid to the top peripheral edge(s) of the vessel) thus applies a certain degree of pressure in relation to the closure (such as through the utilization of a clamp, snap, button, and the like) between lid and vessel and the selected compression level via the mechanical compressor operation. The lid may be provided as a hinged component (removable or not) in relation to the container or a totally removable component that is placed upon the periphery of such a container and pressure-applied for contact and attachment thereto. Certainly, in addition to this initial utilization of the compressor component within the lid, a user may simply just close the lid and secure it to the vessel without any compression activation at all, thereby generating a simple sealing of the lid within the container assembly based upon atmospheric conditions of the environment in which the storage container assembly is located. In its simplest form, then, a user may capture the ambient atmosphere status of the container as it is closed, thereby providing a basic sealed storage capacity to the overall container assembly without such compression application at all. Beyond such a basic result and the initial compression capability, a user may further decide upon generation of an initial compression level that such pressure application is too much and can actually utilize a release valve to allow for decompression to another selected level, if desired. This gives control to the user to effectuate a lower compression level on demand, particularly if the perishable item (again, as an example, *Cannabis* buds, flowers, etc.) would best be stored at a lower level. A third compression level is thus a full vacuum sealing that may be generated through a repeated activation of the compression pump to its maximum level (multiple depressions of the activator, for instance) or a separate pump activator that directly operates a full vacuum level (to a reduction to, for instance 0.1 atmospheres of pressure, or any level or range to such a vacuum result). In this manner, then, the overall capability of the perishable item storage assembly is to accord a user a device that may be set at any compression level on demand for selective storage purposes over any desired time frame and/or period.

The lid, as noted above and as provided as an integrated, removable, or placed structure to the container itself, also includes a mechanical vacuum sealing component that imparts, on demand, removal of air from the container upon pressure contact and attachment thereto and activation of a vacuum pump within the confines (and housing) of the lid itself. Such a lid-based vacuum pump is provided, again, as noted above, with at least two different vacuum settings to provide at least two different levels of vacuum seal results. In effect, as noted above, such a pump may be activated to generate multiple different levels of compression within the enclosed assembly (to provide an initial pressure level, at least, as desired) and may further be decompressed on demand to reduce the pressure therein to any set level after such initial pump operation. In this manner, the lid may include a single activation switch that allows for at least two levels of operation for vacuum applications (such as, without limitation, a first level for removal of a certain amount of air from the container subsequent to lid attachment and sealing, and then a subsequent available level of increased air removal upon application of the first vacuum result, thereby increasing the vacuum level to a higher degree) for the user to select the level of vacuum seal desired for a specific type of perishable item. The lid may thus also include a decompression valve (through openings in the lid, for instance, that may allow for pressure dissipation subsequent to initial compression application). Certainly, the potential for multiple compression levels available with different activation/operation of the mechanical pump may be undertaken if desired, again to generate an initial set level for a certain perishable item. Then, the user may decompress on demand in order to reset the storage pressure level(s) if the initial level is too high in order to permit proper storage of a different item. Additionally, then, the single activation switch may be operated to also generate a full vacuum seal (complete depressing of the activating switch, as one example) or, if desired, a second dedicated switch for such a purpose may be provided on the lid. In any event, this full vacuum seal is permitted in addition to the controlled compression level capabilities noted above. The compression levels applied to the stored item(s) thus can be selected and undertaken for any desired time period. The user may thereafter disengage the compression (vacuum) seal on demand, open the lid, remove any amount of such perishable item(s) as desired, and then, if further desired, close the lid and activate the seal to any selected level again. The lid may also include small openings therein in order to provide decompression capacity as noted above. Such openings may be accessible directly with the utilization of an initial closure provided for the initial low level compression applied or, alternatively, through a second, lower lid component that may permit such opening access through rotation (or other like mechanical) movement of the outer lid. Of particular interest would be an external dial that allows a user the capability of turning such an external component to align with underside openings.

Such a capability has not been explored within the perishable item industry, particularly for the potential for applying different vacuum levels for different storage purposes and/or for different periods of storage times. This container assembly thus provides a certain advantage to the user that a reusable container may be utilized for different types of perishable items at different times with the ability to preselect specific environmental atmospheric results in terms of air present and pressures applied as well. With some types of perishable items, including, as non-limiting examples, *Cannabis*, CBD, and other like medicinal or recreational plants and/or plant derivatives, there are multiple types of products that may require different levels of storage capabilities to best guarantee effectiveness and benefits therefrom. For instance, certain *Cannabis* plants are provided for medicinal usage as they concern flowers, buds, and leaves. Each type of structure from such plants may require unique storage possibilities in order to best ensure the products accord the user the best results over time (from purchase to ultimate use). Thus, a flower may not require anything beyond a simple seal provided by a strong gasket-like structure at the lid and container peripheral edge interface, or the application of a certain low amount of pressure, again, to provide storage stability for such a specific *Cannabis* plant component over time. However, a bud may require, particularly for long-term freshness and retention of full effectiveness, an atmosphere that removes certain oxidizing gases (through vacuum seal), thereby allowing for such long-term trustworthiness. The ability to provide such different plant structures with such versatile storage capabilities is lacking, particularly within the *Cannabis*, CBD, etc., industry. Such a multi-compression level capability within a single device (storage assembly) has not been provided within this specific industry, let alone for other perishable items.

Accordingly, this disclosure is directed to a container assembly having at least one open cavity vessel having at least one body wall and a mouth opening, at least one lid complementary in shape to said at least one open cavity vessel mouth opening such that upon contact and attachment of said at least one lid to said at least one open cavity vessel, no other openings from said at least one vessel are present, wherein said at least one lid includes a gasket structure to generate a seal at said lid and vessel interface, and wherein said at least one lid includes a mechanical compression pump device integrated therein, wherein said mechanical compression pump device includes at least two different vacuum level setting to impart to said at least one vessel upon activation thereof when said at least one lid and said at least one vessel or sealed together at said interface, and at least one opening to allow for decompression. Thus, with such a container assembly, there is provided a method of selectively applying at least three different sealing levels within said at least one vessel during lid application thereto, wherein said mechanical compression pump device provides at least two different sealing levels at different vacuum levels on demand. Such a container assembly thus allows for selective sealing levels for perishable item storage therein.

The container assembly disclosed herein thus includes at least one vessel for placement of at least one perishable item, at least one lid (or cap) with the lid (or cap) having a sealing membrane (film, flexible plastic, any material that provides a gasket-like tight seal upon contact and attachment of the lid and vessel). As noted above, the lid (or cap) may be hinged for connection with the subject vessel (whether permanently or removably attached thereto) or removable and placeable on the periphery thereof such a vessel. The connection interface between the lid (or cap) and the vessel is thus, again, at the vessel peripheral edge (and thus coincidentally at the lid or cap peripheral edge as well). Such an interface is due to complementary shape/contour thereof between such container assembly components to permit a tight seal upon contact and attachment. For such secure attachment, a clamp, snap, pin, button, basically any type of implement for such a sealing technique to be undertaken may be utilized. Preferably, though not necessarily, the lid and vessel may be hinged together and the sealing membrane (gasket, for example) securely and snugly contacts the vessel peripheral edge from the lid peripheral edge and a clamp is utilized on the opposing side of the lid from the hinge placement to firmly close the vessel/lid composite together. In such a manner, then, a perishable item may be placed within the subject vessel and the lid brought down and secured thereover to provide an initial sealed container result.

The vessel itself may be made from any suitable storage capable material, particularly, however, in terms of withstanding high compression applications (from vacuum sealing, as noted herein) and also in terms of preventing appreciable (let alone any) gas penetration upon sealing or gas egress upon sealing, as well. In other words, the material should not exhibit any appreciable level of air entry or exit during sealing (and thus, only exhibits air egress upon application of a vacuum pump from the lid component, as described in greater detail below). Thus, materials such as, without limitation, metal (steel, stainless steel, aluminum, titanium, and brass, as non-limiting examples), glass (such as borosilicate or like glass, as one non-limiting example) with a thickness of at least about 1 cm, plastics, such as, again, without limitation, polyacrylates, polycarbonates, polyolefins, polyesters, plexiglass, and the like, whether transparent or opaque in nature, may be utilized for either or both the vessel and the lid (base, at least). The plastic or glass materials may be infused with different colorants, including pigments, dyes, polyoxyalkylenated chromophores, and the like, to impart hues thereto (for identification/differentiation purposes in relation to stored perishable items), as well as ultraviolet blocking materials to impart protections beyond vacuum sealing to any such stored perishables therein. Additionally, such vessels and/or lids may be provided with internal or external sleeves (cloth, film, paper, and the like) that can be utilized to block light from entering the container assembly, ostensibly to, again, protect the perishable item(s) from external influences (light, ultraviolet rays, etc.) if desired.

The gasket material is preferably a flexible plastic, such as a rubber, including, without limitation, nitrile butadiene rubber, styrene butadiene rubber, silicon rubber, and the like), polyolefin (polyethylene, polypropylene, in particular), basically any material that, again, accords a seal when securely and snugly contacted and attachment via the lid/vessel interface.

The lid (or cap) may be of any material as the vessel (metal, glass, plastic, as non-limiting examples) and the hinge and any attachment implement (clamp, snap, etc.) may likewise be made from sufficiently strong materials (metals and hard plastics, preferably). Such a lid (or cap) thus will further include a mechanical compression pump device therein that includes a vent leading external to the lid (and vessel) and an intake integrated within the pump in order to compress air within the target vessel upon activation thereof (and thus, of course, when the lid and vessel or sealed and attached together). Such a pump may also create a full vacuum, if selected, on demand within the vessel, as well. Thus, a positive displacement pump may be of particular preference simply because of the ability for such a device to either compress or remove air from a closed system easily and quickly. As alluded to above, however, is the utilization of either a pump that allows for a first displacement result and the subsequent capability of a second level of displacement by the same device, or the utilization of two different pump devices (at least two) within the same lid component in order to allow for two separate pumps to displace gases at different times. Certainly, upon the activation of a first compression pump in this manner, the initial level of pressure within the subject vessel will achieve a first result. The subsequent application of decompression to the same subject vessel will remove further amounts of gases therefrom to achieve a lower level of compression, if desired. The application then of a full vacuum, again, allows for a seal for longer storage capability, within the same versatile storage assembly. As such, either way, the resultant capability of the container assembly is to provide at least three different sealing levels for the user to undertake in relation to any specific type or types of perishable items for storage capacity thereof over any duration of time(s). Of course, if further desired, the user may include further compression level capabilities for greater versatility in terms of storage capabilities, as well.

The positive displacement (or other like compression and/or vacuum) pump may be housed in plastic or metal (as above for the vessel and lid) as long as such housing is not compromised upon application of power to displace gases from the vessel and out through the lid. Such a pump may be powered by batteries (that may be replaced or recharged, depending on type) or, if desired, may be powered through an electric cord within a proper port within the lid. The lid (or cap), or the vessel itself, may also include indicators as to the vacuum seal level selected, whether in relation to the activator operated by the user (such as a button to depress for an initial vacuum application and then the same or another button for a subsequent seal application) or the resultant level of compression imparted within the subject vessel itself. Thus, in either situation, the user may be provided sufficient information to understand the selected compression or vacuum level(s) involved at any one time. Additionally, the subject vessel (or the lid underside) may include any number and type of sensors that allow for monitoring of different characteristics and statuses of the container assembly itself or the perishable item(s) stored therein at any time. As such, sensors providing internal (and possible item) temperature, time duration of storage upon initial sealing, and even weight (particularly with a scale provided within the vessel bottom) may be employed. Such may be provided wirelessly to an external database for such monitoring capabilities (Bluetooth, for instance, may be utilized for communication from sensor to database or other receiver, such as an app within a smartphone, as one non-limiting possibility) or provided simply through a readout on the vessel or the lid top (such as LED or quartz lights generating results in such a manner). Additionally, there may be implemented a further monitoring system in relation to the duration of storage each type of perishable item is subjected to, particularly under specific compression levels from the vacuum seal usage. Such a possible system may thus allow, particularly for certain *Cannabis* items, the ability to determine, through comparison with a database or app associated therewith, the optimum storage durations for different products (whether flower, bud, leaf, etc.), thereby allowing more pertinent monitoring capabilities associated with vacuum seal storage levels, ultimately allowing for the most poignant and pertinent results as to the freshness and effectiveness of such products for their desired use (medicinal or otherwise).

In addition to these possible components, there may be present an automated grinder within the vessel itself, particularly to allow separation of perishable items portions as desired for storage purposes. Particularly as it concerns *Cannabis* and like perishable items, the ability to grind buds or other selected items automatically allows for the generation of kief (*Cannabis* "crystals") rather than simply collecting such residual plant portions from stored items. In any event, such a grinder may be present at the mouth opening (allowing for drop in of buds and other items that are ground to desired levels) or within the vessel, thereby allowing for fuller collection of kief subsequent to grinding and settling to the vessel bottom.

There is no limit as to the size of the storage assembly itself. As it concerns such an issue, the important criteria relate to storage capacity and, if needed, facilitation of storage and transport. Thus, any range of sizes from 100 milliliters (or even less, if desired) up to 2 liters (or possibly larger) may be provided in relation to this storage assembly disclosure. Furthermore, as it concerns dimensions, as long as such an assembly includes a vessel that comports to the needs of the user, such as, in terms of *Cannabis*, at least, the ability to properly and reliably store stems as well as flowers, buds, etc., and still allow for compression levels applied through the lid-based (or other located, if needed) pump device, then all is within the purview of this disclosure. Thus, a height of anywhere from 10 centimeter to 350 centimeters, as one possible range of sizes, a width of the same, and a depth of the same range, as well, may be employed. Any sizes for any dimension in between may be utilized as well with the same basic effect, with storage capacity for certain dimensions of perishable items the basis of any such selection (again, a taller, deeper, and wider vessel may be needed for products with stems in order to allow for suitable capacity overall).

Additionally, then, there is also the potential to include multiple vessels within a single integrated structure to permit storage of different perishable items within a single container assembly but with different vacuum seal application for each simultaneously. In such a manner, multiple lids (or caps) may be utilized with such integrated and separated vessels (basically a single structure with multiple separating walls therein to prevent gas transfer from one separated portion to another. Multiple lids (with pump devices therein) may be utilized with one lid per separated vessel portion in order to accord such a multi-unit storage container assembly. In such a situation, for example, a user may purchase an entire *Cannabis* product with flower, bud, leaf, etc., but needs to have each stored differently in terms of vacuum seal application. The ability to have such storage capability simultaneously within a single container assembly allows for potentially easier monitoring and tracking of which product was purchased, stored, and thus to be used appropriately, all together. The same alternatives noted above may thus be implemented for each vessel portion with different scales in each, different temperature, etc., monitoring sensors, and different external indicators as to vacuum seal level applications. Such multi-compartmented structures may thus be cube-shaped with at least three separated and closeable portions in this manner, or they may be cylindrical with different access longitudinally or latitudinally, as desired. The base container assembly with a single vessel and lid utilized for such storage capabilities, may be of any geometric shape, as well, of course.

Additionally, the storage assembly may include a handle (rigid or movable) to facilitate transport and carrying thereof on demand. The size may be amendable to such facilitated carriage as well, if desired.

BRIEF DESCRIPTION OF THE DRAWINGS

The foregoing summary, as well as the following detailed description of a preferred embodiment of the container assembly of the present disclosure, will be better understood when read in conjunction with the appended drawings. For the purposes of illustrating the preferred container assembly, preferred embodiments of the present disclosure are shown in the drawings. It should be understood, however, that the description is not limited to the precise arrangements and instrumentalities shown. In the drawings.

DETAILED DESCRIPTION OF THE DRAWINGS AND PREFERRED EMBODIMENTS

FIGS. 1 through 7, discussed below, and the various embodiments used to describe the principles of the present disclosure are by way of illustration only and should not be construed in any way to limit the scope of the disclosure. Those skilled in the art will understand that these principles may be implemented in any type of suitably arranged device or system.

Figure 1:
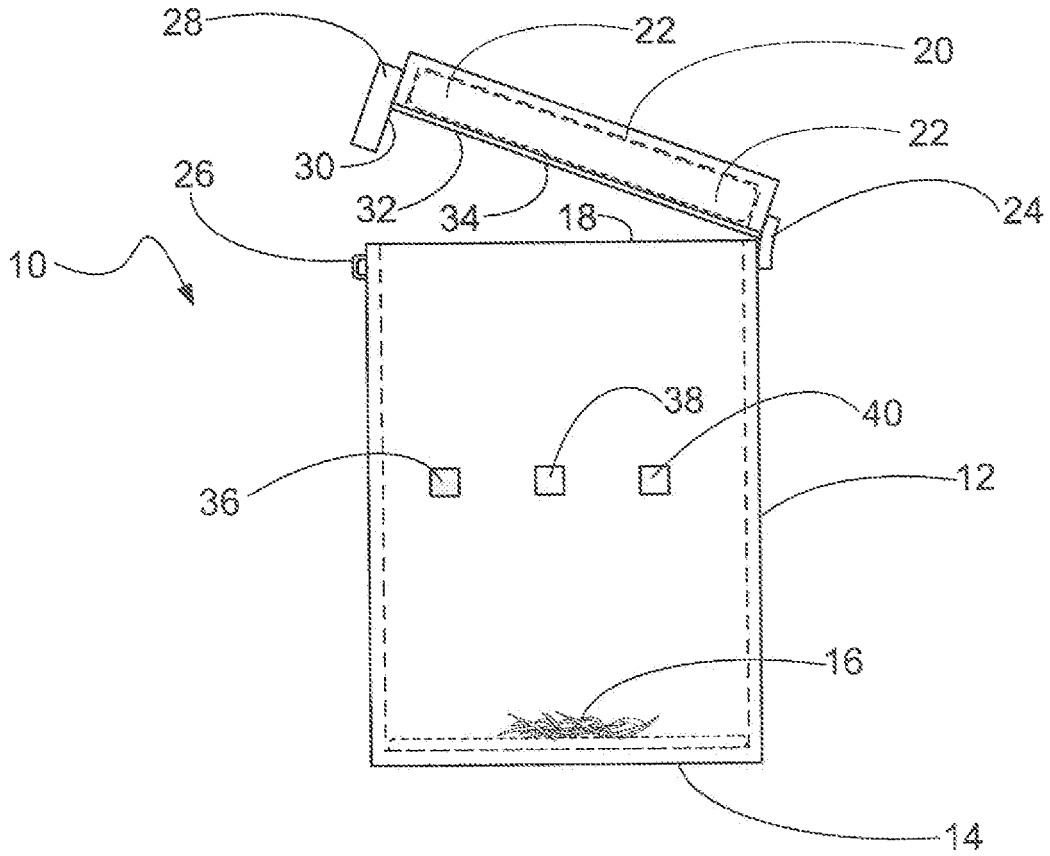
FIG. 1 a side view of a potentially preferred container assembly.
Figure 2:
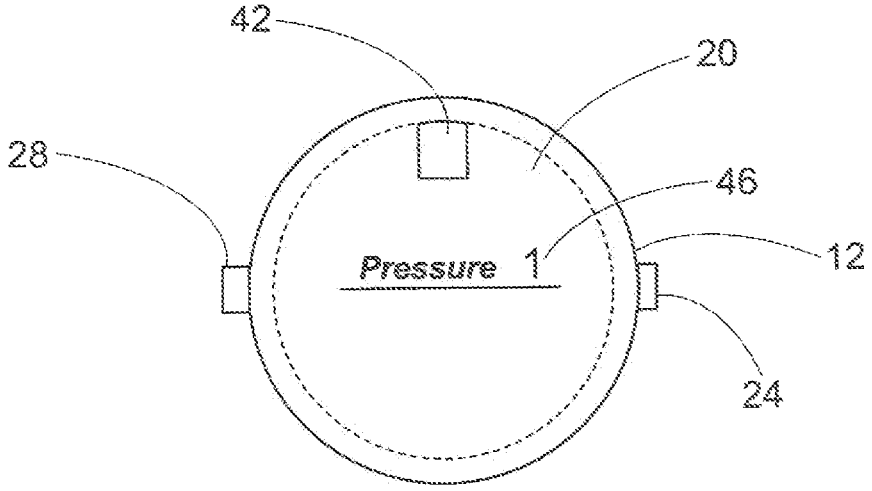
FIG. 2 is an aerial perspective view of the assembly of FIG. 1 with the lid closed and vacuum seal applied.
Figure 3:
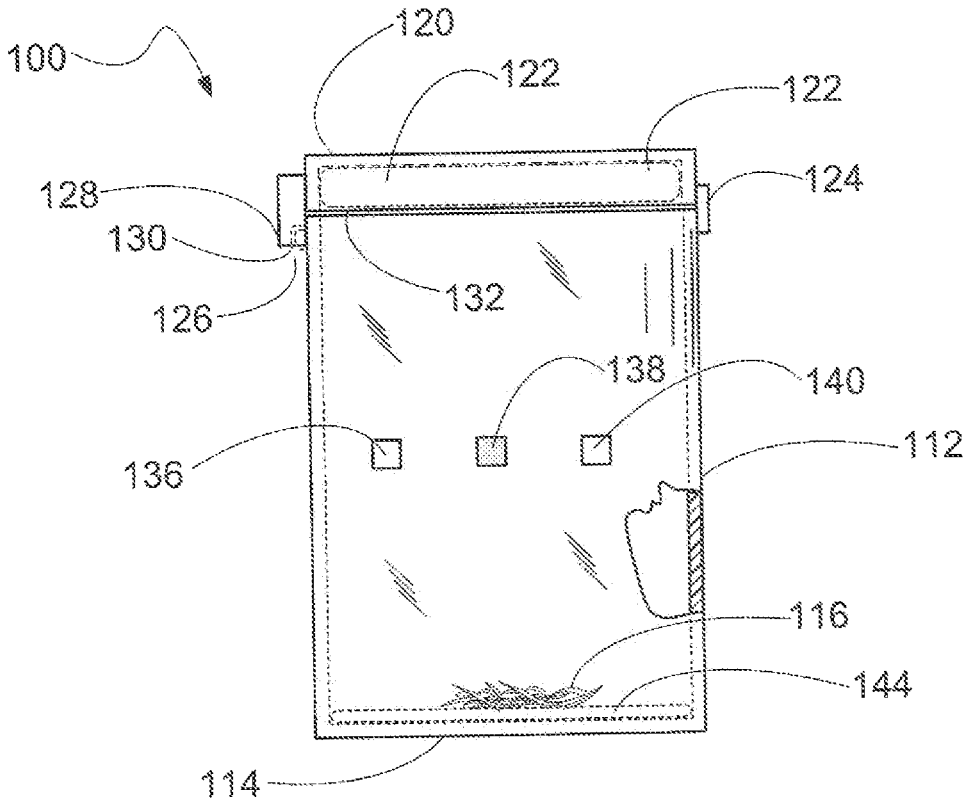
FIG. 3 is a side view of the potential embodiment of the article of FIG. 2 showing the placement and storage of a perishable item therein.

FIGS. 1-2 illustrate one possible embodiment of a disclosed container assembly 10 as disclosed herein. In FIG. 1, there is provided a side view of the assembly 10, with an open lid 12, including therein a compression pump 22, a gasket 32, including lid openings 34 for decompression. Also present in this potential possible embodiment are a hinge 24 (attached to the vessel component 12) and an opposing side latch 28 with a hook 30 that is complementary in shape and location with a loop structure 26 on the vessel 12 for secure and sealed contact and attachment of the lid 20 and the vessel 12 (over the vessel mouth opening 18). Associated with the compression pump 22 is a button 42 for activation thereof on demand. As noted above, two different pumps may be utilized (and thus would necessitate a second button for such operation). The vessel 12 includes a bottom edge 14 onto which perishable items 16 are placed for storage therein. Upon closure of the lid 20 through the sealing gasket 32 with the vessel mouth opening 18, there is present a potential sensor (not illustrated) that conveys a signal to one of three indicators 36, 38, 40 within the external side (or possibly in the internal wall for external viewing) of the vessel 12 in relation to activation of the compression pump. Upon this initial closure, latching, and compression pump activation, an initial compression level is generated and the first indicator 36 is illuminated. FIG. 2 shows the closed lid 20 on top of the vessel 12 with an indication of such compression level as well 46. Certainly, any type of indication may be provided, even in terms of colors as to the status of the pressurized vessel (canister, container, etc.), with green showing a suitable result, red showing pressure has stopped, and yellow that a problem potentially exists as to the pressure application. Basically, any type of indication as to the pressure application for compression results may be implemented and indicated on the lid and/or on the vessel wall(s) as well. Although such a vessel 12 is shown as a cylindrical jar in this potential embodiment, it should be understood and evident that any shape that allows for pressure application and secure and reliable closure thereof such a vessel 12 may be employed (and such shape, etc., may be implemented for any potential embodiment, as well).

Figure 4:
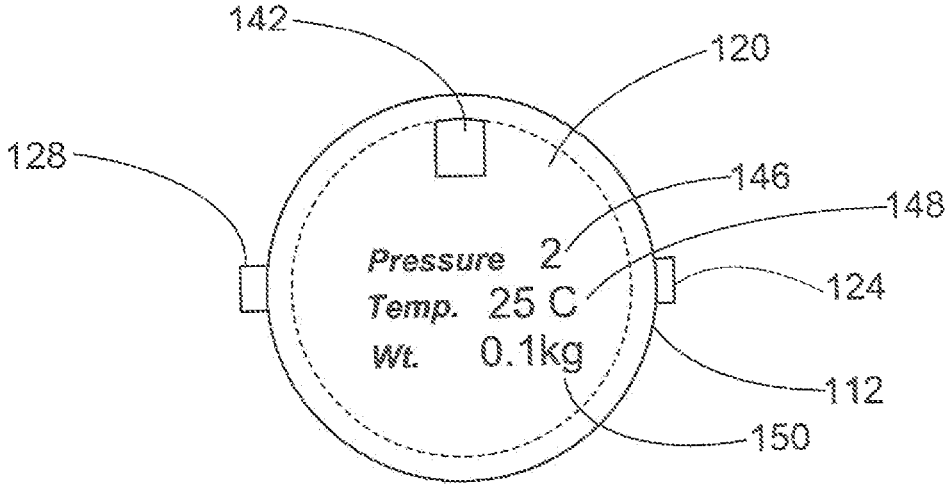
FIG. 4 is a top view of the lid with a different vacuum seal applied.
Figure 5:
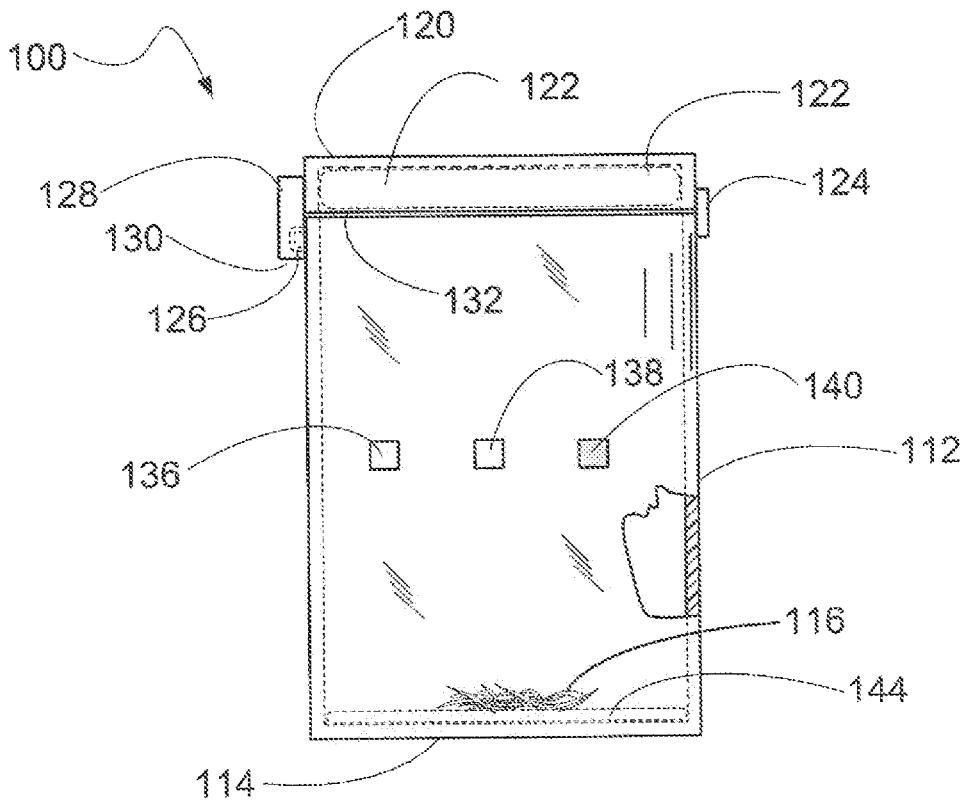
FIG. 5 is a side view with a different perishable item present therein in relation to the vacuum seal of FIG. 4.
Figure 6:
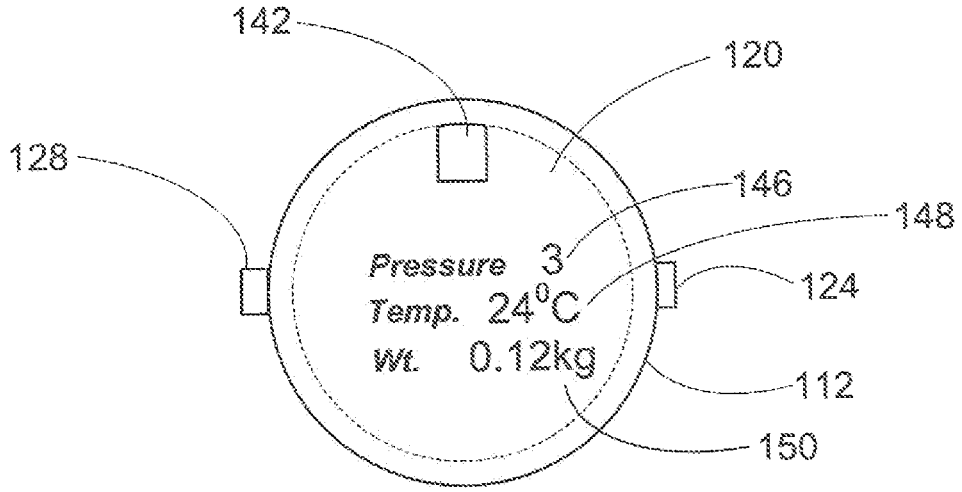
FIG. 6 is a top view showing a readout of weight and temperature.

FIGS. 3-6 show a different type of assembly 110 with a vessel 112 included a scale 144 within the bottom 114 thereof to monitor the weight of the item stored continuously or at any time a user decides to analyze such a characteristic of the stored perishable item (on demand). Otherwise, such an assembly 110 includes the same type of lid 120 with a compression pump 122, hinge 124, latch 128, hook 130, vessel loop 126, gasket 132, and status indicators 136, 138, 140 on the vessel 112. In this alternative, there may also be a temperature (or other type of sensor, not illustrated) to provide instant measurements thereof for a user. The aerial views in FIGS. 4 and 6 show the lid 120 secured to a vessel 112 with different pressures applied. FIG. 4 (and FIG. 3, for that matter) shows an intermediate compression (initial compression level adjusted to a lower level through decompression) employed for the stored items 216, with the second indicator 138 and lid pressure notation 146 providing such notifications. Additionally, the lid 112 provides indication of the current internal temperature 148 as well as the weight 150 thereof of the product (item) 116. The assembly 110 of FIGS. 5 and 6 show the application of a vacuum seal level through operation of the compression pump to a maximum vacuum seal level with the indications 146, 150 denoting such an effect.

In this manner, there is provided a means of not only generating different compression levels for stored perishable items within storage assemblies, but also varying capabilities of monitoring such storage statuses over time. As noted above, this allows for more specific storage results, particularly for certain perishable items that may include different components from a single source with storage stable needs to deliver effective and desirable results for a user, ostensibly to permit more reliable long-term (or short-term) result in relation to investment of money and time.

Figure 7:
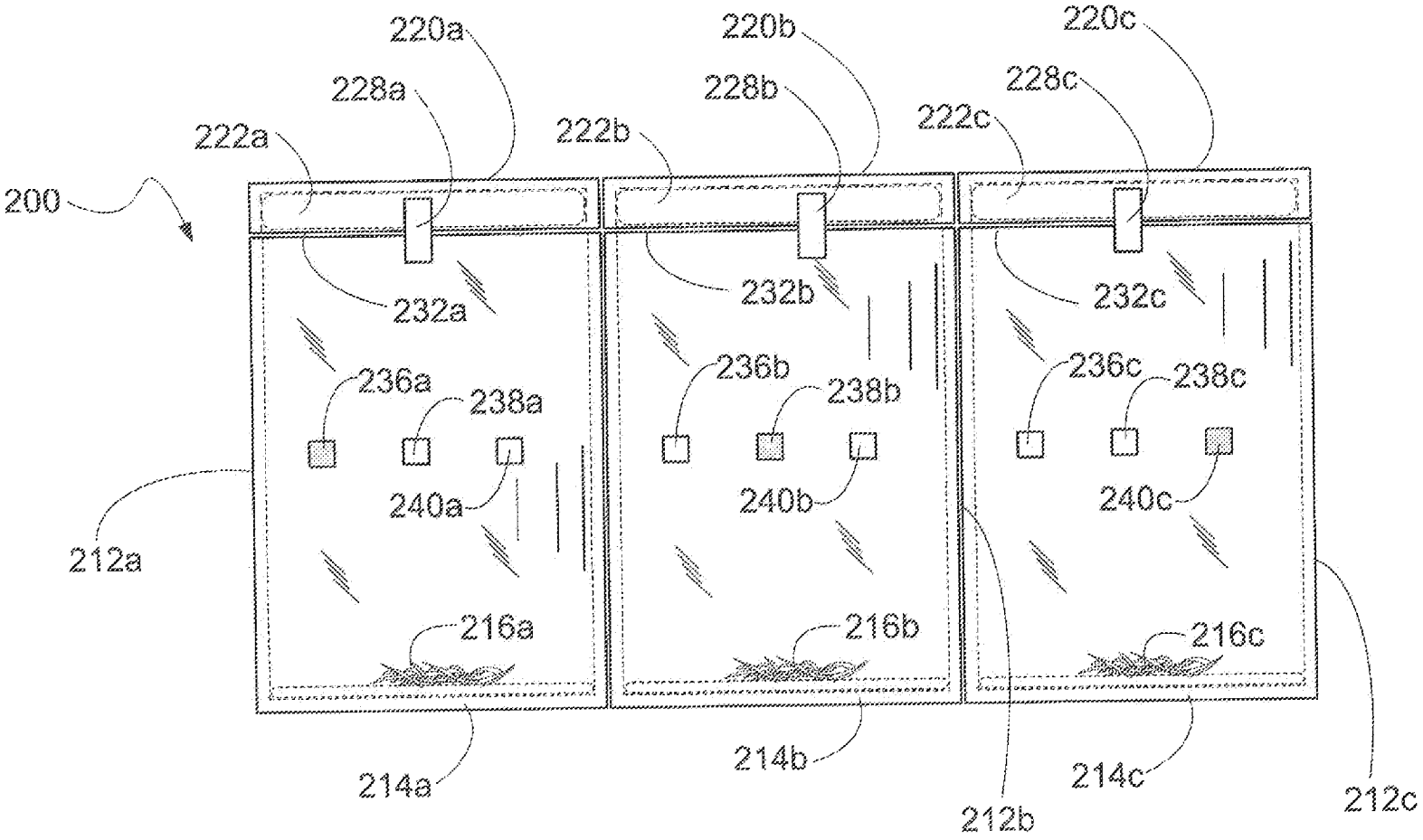
FIG. 7 is a side view with multiple vessel portions integrated within a single container assembly.

FIG. 7 shows another potential embodiment with the assembly 200 including three integrated vessels 212A, 212B, 212C with separate lids 220A, 220B, 220C, with separate compression pumps 222A, 222B, 222C, hinges 224A, 224B, 224C, and latches 228A, 228B, 228C, 232A, 232B, 232C. The vessels 212A, 212B, 212C, include bottom edges 214A, 214B, 214C, on which different perishable items 216A, 216B, 216C, have been placed and applied at different compression levels as shown by the indicators 236A, 236B, 236C, 238A, 238B, 238C, 240A, 240B, 240C (vessel 212A showing a first level 236A, vessel 212B a second level 238B, and third vessel 212C a strongest level 240C).

The various components and operations shown in each of FIGS. 1 through 7 may be incorporated in other figures without departing from the scope of this disclosure. Modifications, additions, or omissions may be made to the systems, apparatuses, and methods described herein without departing from the scope of this disclosure. The components of the systems and apparatuses may be integrated or separated. Moreover, the operations of the systems and apparatuses may be performed by more, fewer, or other components. The methods may include more, fewer, or other operations. Additionally, operations may be performed in any suitable order. As used in this document, "each" refers to each member of a set or each member of a subset of a set.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of the disclosure, as defined by the following claims.

What is claimed is:

1. A storage container assembly having at least one open cavity vessel, at least one lid complementary in shape to said at least one open cavity vessel having at least one body wall, a bottom edge for placement of perishable items, and a mouth opening, such that upon contact and attachment of said at least one lid to said at least one open cavity vessel no other openings from said at least one vessel are present, wherein said at least one lid includes a gasket structure to generate a seal at said lid and vessel interface, wherein said at least one open cavity vessel includes a scale located within said bottom edge, wherein said at least one open cavity vessel includes an internal temperature sensor therein, wherein said at least one lid includes a mechanical compression pump device integrated therein, wherein said mechanical compression pump device includes at least two different pressure level settings to impart to said at least one vessel upon activation thereof when said at least one lid and said at least one vessel are sealed together at said interface, and wherein said lid includes a readout indicating the exact weight of said perishable items within said vessel in relation to said scale, the exact internal temperature of said vessel in relation to said temperature sensor therein, and at least one of said at least two different pressure level settings.

2. A method of storing perishable items utilizing said storage container assembly of claim 1, said method including selectively applying at least three different sealing levels within said at least one vessel during lid application thereto, wherein said mechanical compression pump device provides at least three different compression levels on demand, and wherein said readout indicating at least one of said at least three different pressure level settings.

3. The method of storing perishable items of claim 2 wherein said perishable items are selected from *Cannabis*, CBD, and tobacco.

4. The method of storing perishable items of claim 3 wherein said perishable items are *Cannabis*.

5. The method of storing perishable items of claim 4 wherein said *Cannabis* may be stored as one of a stem, bud, or flower thereof, and said compression levels permit storage of such different *Cannabis* structure on demand for optimum storage thereof.

6. The storage container assembly of claim 1 wherein said at least one open cavity vessel comprises a body wall of plastic or glass infused with at least one ultraviolet blocker therein.

7. A multiple storage container assembly comprising a plurality of storage container assemblies of claim 1 integrated into a single structure.

8. The storage container assembly of claim 1 further including a grinder component within said lid.

* * * * *